US007131386B1

(12) United States Patent
Caldwell

(10) Patent No.: US 7,131,386 B1
(45) Date of Patent: Nov. 7, 2006

(54) MARINE PROPULSION SYSTEM WITH PRESSURE COMPENSATED HYDRAULIC SUPPLY CAPABILITY

(75) Inventor: Rodney M. Caldwell, Pawnee, OK (US)

(73) Assignee: Brunswick Corporation, Lake Forest, IL (US)

( * ) Notice: Subject to any disclaimer, the term of this patent is extended or adjusted under 35 U.S.C. 154(b) by 141 days.

(21) Appl. No.: 10/843,274

(22) Filed: May 11, 2004

(51) Int. Cl.
*B63J 3/00* (2006.01)
*B63H 25/22* (2006.01)
*F02B 17/03* (2006.01)
*F02B 17/05* (2006.01)

(52) U.S. Cl. ..... 114/150; 114/286; 440/61 R

(58) Field of Classification Search ..... 440/3–6, 440/61 R–61 J; 477/2–6; 74/661; 180/53.4, 180/65.2, 65.3, 65.4; 417/16, 223, 362, 364; 114/144 R, 150, 285–287
See application file for complete search history.

(56) References Cited

U.S. PATENT DOCUMENTS

| | | | | |
|---|---|---|---|---|
| 3,784,326 | A | 1/1974 | Lagana et al. | 417/221 |
| 3,844,130 | A * | 10/1974 | Wahnish | 62/133 |
| 3,914,939 | A | 10/1975 | Purdy | 60/422 |
| 4,265,192 | A | 5/1981 | Dunn | 114/151 |
| 4,273,543 | A * | 6/1981 | McCusker | 440/4 |
| 4,289,452 | A | 9/1981 | Kubilos | 417/222 |
| 4,698,035 | A | 10/1987 | Ferguson | 440/61 |
| 5,177,978 | A * | 1/1993 | Brown | 62/236 |
| 5,476,400 | A | 12/1995 | Theophanides | 440/5 |
| 5,755,303 | A * | 5/1998 | Yamamoto et al. | 180/65.2 |
| 6,273,771 | B1 | 8/2001 | Buckley et al. | 440/84 |
| 6,341,623 | B1 | 1/2002 | Channing | 137/565.22 |
| 6,547,527 | B1 * | 4/2003 | Gaither | 417/16 |
| 6,547,610 | B1 | 4/2003 | Kim | 440/5 |
| 6,554,662 | B1 | 4/2003 | Hedlund et al. | 440/61 |
| 6,708,787 | B1 * | 3/2004 | Naruse et al. | 180/53.8 |
| 6,973,781 | B1 * | 12/2005 | Brown et al. | 60/413 |
| 2004/0222000 | A1 * | 11/2004 | Ohtsukasa | 172/2 |
| 2005/0036894 | A1 * | 2/2005 | Oguri | 417/212 |

FOREIGN PATENT DOCUMENTS

| | | | |
|---|---|---|---|
| JP | 11107936 | A * | 4/1999 |
| JP | 2001099103 | A * | 4/2001 |
| JP | 2002089435 | A * | 3/2002 |
| JP | 2003009308 | A * | 1/2003 |

* cited by examiner

*Primary Examiner*—Ajay Vasudeva
(74) *Attorney, Agent, or Firm*—William D. Lanyi

(57) ABSTRACT

A hydraulic system for a marine vessel incorporates a single hydraulic pump that can be driven by either first or second motive devices, such as an internal combustion engine or an electric motor. Depending on the circumstances, the pressure required by the hydraulic system is provided by the pump when it is driven by either the first or second motive devices. As a result, only two motive devices can provide the necessary driving capacity for the hydraulic pump under all operating circumstances, including those when the engine is not running.

13 Claims, 3 Drawing Sheets

MARINE PROPULSION SYSTEM WITH PRESSURE COMPENSATED HYDRAULIC SUPPLY CAPABILITY

BACKGROUND OF THE INVENTION

1. Field of the Invention

The present invention is generally related to a hydraulic system for a marine vessel and, more particularly, to a hydraulic system that uses two alternative motive devices to drive a hydraulic pump which maintains a preselected pressure in a hydraulic system to which a plurality of hydraulic components are connected.

2. Description of the Prior Art

Many different types of hydraulic systems are known to those skilled in the art.

U.S. Pat. No. 4,265,192, which issued to Dunn on May 5, 1981, describes an auxiliary hydraulic maneuvering system for small boats. A hydraulic pump driven by any suitable power source, such as by an electric motor energized from a storage battery, supplies water under hydraulic pressure by way of a control valve unit to a plurality of pairs of downwardly and outwardly-inclined nozzles disposed at various locations around the boat's hull above the water line thereof.

U.S. Pat. No. 6,554,662, which issued to Hedlund et al. on Apr. 29, 2003, describes a hydraulic system in a boat hull, preferably a boat hull having an outboard drive. An hydraulic installation in a boat hull is described for swinging a propeller rig pivotably suspended in a shell on a boat transom using a piston-cylinder device arranged in a hydraulic control circuit. A control valve included in the hydraulic circuit for controlling the flow to and from the hydraulic cylinder is sealingly mounted in a through-opening in the shell, so that one side of the valve faces outwardly towards the propeller rig in order to be subjected to water spray during driving and serve as an oil cooler.

U.S. Pat. No. 5,476,400, which issued to Theophanides on Dec. 19, 1995, describes a hydraulic power system for a boat. The system comprises a marine thruster assembly. A structure is for mounting the marine thruster assembly to an external surface of a transom on the boat. A first hydraulic operative facility is for propelling the marine thruster assembly, so that the boat can travel in a body of water. A second hydraulic operative facility is for steering the marine thruster assembly, so that the boat can be directed on a course in the body of water. A third hydraulic operative facility is for lifting the marine thruster assembly out of the body of water for inspection and repair when needed.

U.S. Pat. No. 4,698,035, which issued to Ferguson on Oct. 6, 1987, describes a marine propulsion device hydraulic system. The device comprises a propulsion unit adapted to be pivotally mounted on the transom of a boat for pivotal movement relative to the transom about a steering axis, the propulsion unit including a rotatably mounted propeller, an engine including a throttle lever, and a shiftable transmission drivingly connecting the engine to the propeller and including a shift lever, a hydraulic shift assist system connected to the shift lever for actuation thereof, a hydraulic throttle assist system connected to the throttle lever for actuation thereof, a hydraulic fluid reservoir, a pump communicating with the reservoir, a supply conduit communicating between the pump and the shift assist system, a supply conduit communicating between the shift assist system and the throttle assist system, and a return conduit communicating between the throttle assist system and the reservoir.

U.S. Pat. No. 6,547,610, which issued to Kim on Apr. 15, 2003, describes a parallel-operated hydraulic motor type stern propulsion apparatus for boats and hydraulic system for controlling the same. The parallel-operated motor type stern propulsion apparatus for boats and hydraulic system is described. The stern propulsion apparatus includes a transom box disposed at the stern of a boat. A propulsion body situated in the transom body to be lifted and steered is described in combination with the propulsion body which includes an upper body supported by a lifting shaft transversly fitted into the transom box, a yoke connected to the lower body, and two lower bodies each attached to each of the lower ends of the yoke.

U.S. Pat. No. 6,273,771, which issued to Buckley et al. on Aug. 14, 2001, discloses a control system for a marine vessel. The control system incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 3,914,939, which issued to Purdy on Oct. 28, 1975, describes a pressure compensated pump. A control circuit for regulating the output of a variable displacement pump in response to the total demand called for by a plurality of manually operable fluid motor control valves is described. Each motor control valve has an associated flow control valve connected in series with it. The flow control valves are connected in series with each other, each dividing the flow which it receives between its associated motor control valve and the next downstream flow control valve.

U.S. Pat. No. 6,341,623, which issued to Channing on Jan. 29, 2002, describes a variable orifice, pressure compensated automated fuel jet pump. The pump is provided with a first chamber having a rear end sealed from a front body by a pressure communicative boundary. The first chamber front end has an inlet fluidly connected with a source of pressurized fluid. The first chamber front end also has a nozzle outlet. A second chamber is provided having a first inlet fluidly connected with the first chamber outlet. The second chamber has a second inlet fluidly connected with a sump. The second chamber has a delivery outlet. A valve member is operatively associated with the first chamber boundary for controlling a flow from the first chamber inlet through the first chamber outlet. A position of the valve member with respect to the first chamber outlet is responsive to a pressure differential between the first chamber front end and the rear end.

U.S. Pat. No. 3,784,326, which issued to Lagana et al. on Jan. 8, 1974, describes a pressure compensated pump. A constant pressure fluid source is provided by operating a balanced variable displacement vane pump as a pressure compensated device. The pressure differential across the pump is sensed and employed to hydraulically and automatically control pump displacement by adjusting the position of the movable seal blocks with respect to the rotor to thereby regulate flow in the interest of maintaining the desired output pressure.

U.S. Pat. No. 4,289,452, which issued to Kubilos on Sep. 15, 1981, describes a pressure compensated pump. The pump has a pressure compensator valve connected to a stroking piston. When the discharge pressure exceeds a set maximum, the compensator valve connects pressure fluid to the stroking piston to reduce the displacement of the pump. The flow of pressure fluid to the stroking piston is accompanied by a concurrent flow of fluid to case.

The patents described above are hereby expressly incorporated by reference in the description of the present invention.

In a marine vessel hydraulic system, those skilled in the art are familiar with many devices that are operated through the use of hydraulic pressure. However, marine vessel hydraulic systems typically utilize numerous hydraulic pumps which are each designated to operate one hydraulic device. As an example, a hydraulic pump can be driven by a belt system connected in torque transmitting relation with the crankshaft of an internal combustion engine. Alternatively, some hydraulic devices are provided with an individual hydraulic pump driven by a dedicated electric motor. In a typical arrangement, a hydraulic pump used for a hydraulic steering system is driven by belts connected to the internal combustion engine. The power trim system of the marine propulsion unit is typically driven by a hydraulic pump that is operated by a dedicated electric motor connected to a battery. When the internal combustion engine is not operating, stand alone hydraulic pumps are driven by stand alone electric motors to provide hydraulic pressure to operate various systems, such as the power trim system which is needed to raise the marine propulsion device upwardly relative to the transom of the boat.

It would be beneficial to the hydraulic system of a marine vessel if a single hydraulic system could be provided with a single pressure compensated pump that can supply hydraulic pressure to numerous hydraulic devices on the marine vessel. This would provide savings and avoid the redundant provision of numerous hydraulic pumps which are each dedicated to their own motive device.

SUMMARY OF THE INVENTION

A hydraulic system for a marine vessel, made in accordance with a preferred embodiment of the present invention, comprises a fluid conduit and a hydraulic pump which is connected to the fluid conduit. A first motive device is selectively connectable in force transmitting relation with the hydraulic pump and a second motive device is also selectively connectable in force transmitting relation with the hydraulic pump. In a preferred embodiment of the present invention, the first and second motive devices are alternatively connectable to the hydraulic pump.

In a preferred embodiment of the present invention, a first clutch is connected between the hydraulic pump and the first motive device to alternatively connect the first motive device to the hydraulic pump and disconnect the first motive device from the hydraulic pump. A second clutch is connected between the hydraulic pump and the second motive device to alternatively connect the second motive device to the hydraulic pump and disconnect the second motive device from the hydraulic pump. In a preferred embodiment, the hydraulic pump is configured to maintain a preselected pressure within the fluid conduit. The hydraulic pump can be a pressure compensated pump.

The first motive device can be an internal combustion engine and, more specifically, can comprise a belt and pulley arrangement connecting the hydraulic pump in torque transmitting relation with a crankshaft of the internal combustion engine. The second motive device can comprise an electric motor which is connected in torque transmitting relation with the hydraulic pump. A battery can be connectable to the second motive device to provide electric power to the second motive device when the second motive device is connected in force transmitting relation with the hydraulic pump.

A hydraulically driven device can be connected in fluid communication with the fluid conduit. The hydraulically driven device can be one selected from the group consisting of a power steering system, a trim tab system, a power trim system, and a hydraulic transmission clutch. The fluid conduit can comprise a first conduit for conducting a pressurized liquid from the hydraulic pump to the hydraulically driven devices and a second conduit for conducting the pressurized liquid to a liquid reservoir from the hydraulically driven devices.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
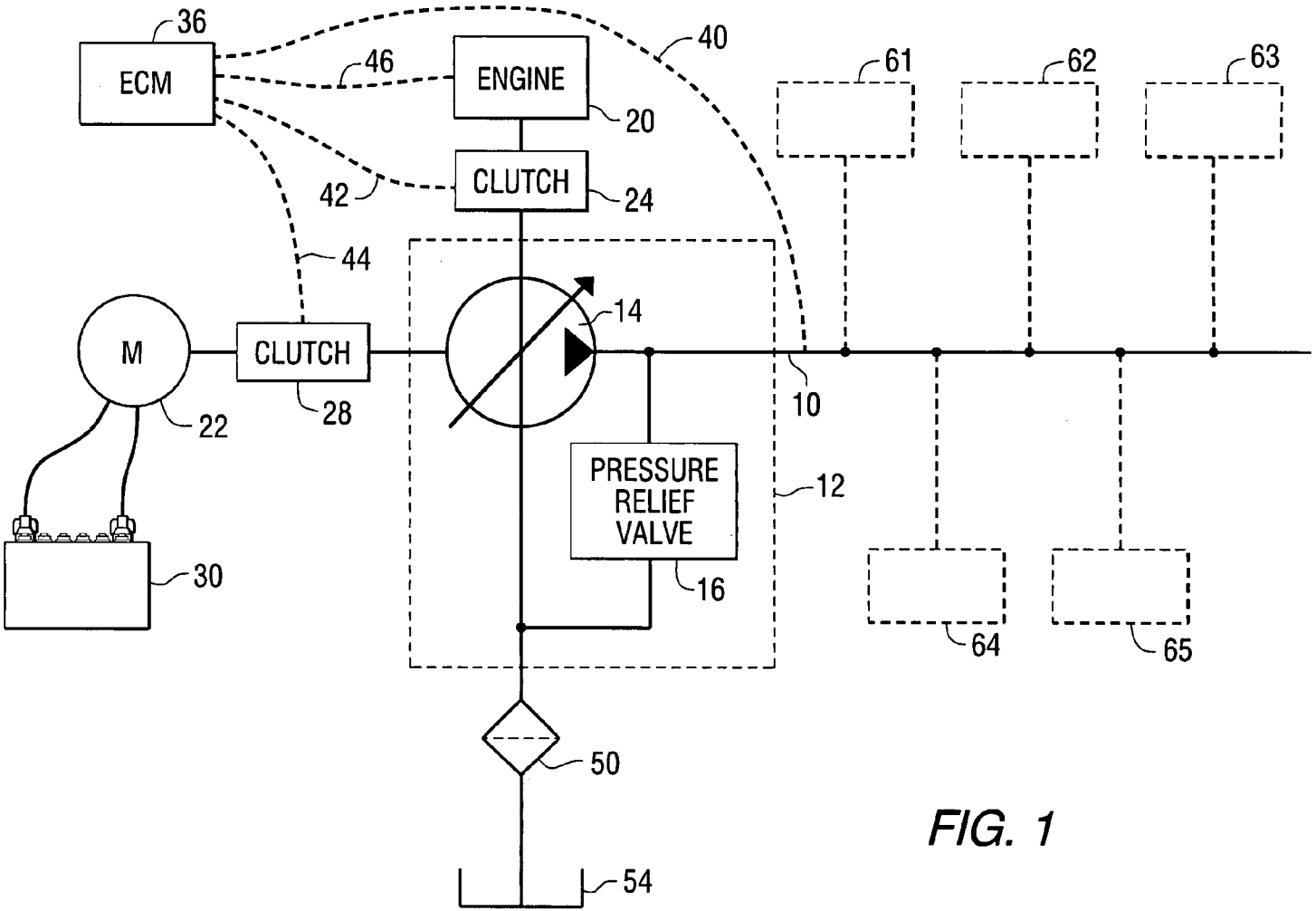
FIG. 1 is a schematic representation of the present invention.

Throughout the description of the preferred embodiment of the present invention, like components will be identified by like reference numerals.

FIG. 1 shows a hydraulic system for a marine vessel incorporating some of the basic concepts of the present invention. A fluid conduit 10 is connected to a hydraulic pumping system 12 which comprises a hydraulic pump 14 and a pressure relief valve 16. Pressure compensated pumps are well known to those skilled in the art and can be of several alternative types. U.S. Pat. Nos. 3,914,939 and 6,341,623 describe two types of pressure compensated pumps. U.S. Pat. Nos. 3,784,326 and 4,289,452 describe two alternative types of pressure compensated pumps. In addition, certain types of hydraulic pumps can incorporate variable displacement systems that can operate, in certain cases, in conjunction with a swashplate that is movable to control the stroke of one or more pistons. Since pressure compensated pumps, such as hydraulic pump 14, are well known to those skilled in the art, the specific operation of the pumping system 12 will not be further described herein.

With continued reference to FIG. 1, the present invention further comprises a first motive device 20 which is selectively connectable in force transmitting relation with the hydraulic pump 14. A second motive device 22, such as an electric motor, is selectively connectable in force transmitting relation with the hydraulic pump 14. A first clutch 24 can be connected between the hydraulic pump 14 and the first motive device 20, which is illustrated as an internal combustion engine in FIG. 1, to alternatively connect the first motive device 20 to the hydraulic pump 14 and to disconnect the first-motive device 20 from the hydraulic pump 14. A second clutch 28 is connected between the hydraulic pump 14 and the second motive device 22, which is an electric motor in FIG. 1, to alternatively connect the second motive device 22 to the hydraulic pump 14 and disconnect the second motive device 22 from the hydraulic pump 14. In a typical application of the present invention, clutch 28 is disengaged when clutch 24 is engaged and vice versa. This allows the hydraulic pump 14 to be driven by either the first motive device 20 or the second motive device 22 while avoiding the situation where either the first or second motive devices must overcome the resistance of the other motive device when driving the hydraulic pump 14.

With continued reference to FIG. 1, the hydraulic pump 14 is configured to maintain a preselected pressure within the fluid conduit 10. In a particularly preferred embodiment of the present invention, the preselected pressure is approximately 2500 psi. The hydraulic pump 14 can be a pressure compensated pump that is generally similar to those described above. The first motive device 20, as described above, can be an internal combustion engine. In certain embodiments of the present invention, a battery 30 is connectable to the second motive device 22 to provide electrical power. An engine control module 36 can be connected to the present invention in certain embodiments. Although it should be understood that the present invention can operate satisfactorily with a combination of electromechanical devices and relays, certain embodiments can advantageously utilize an engine control module 36 which comprises a microprocessor. As an example, the pressure in the fluid conduit 10 can be measured, on line 40, by the engine control module. In addition, the status of the clutches, 24 and 28, can be controlled by the connection illustrated as lines 42 and 44. Also, the status of the engine 20 can be monitored by the engine control module 36 by the connection represented by line 46.

With continued reference to FIG. 1, reference numeral 50 identifies a filter assembly, reference numeral 54 identifies a hydraulic fluid reservoir, and the dashed boxes 61–65 represent hydraulic devices that are connectable to the fluid conduit 10. It should be understood that many different types of hydraulic devices can be connected to the fluid conduit 10 to obtain hydraulic pressure for their respective operations. These hydraulic devices, 61–65, can be steering components, trim tab components, power trim and tilt components or hydraulic clutch components. The specific nature of the hydraulic devices is not limiting to the present invention.

Figure 2:
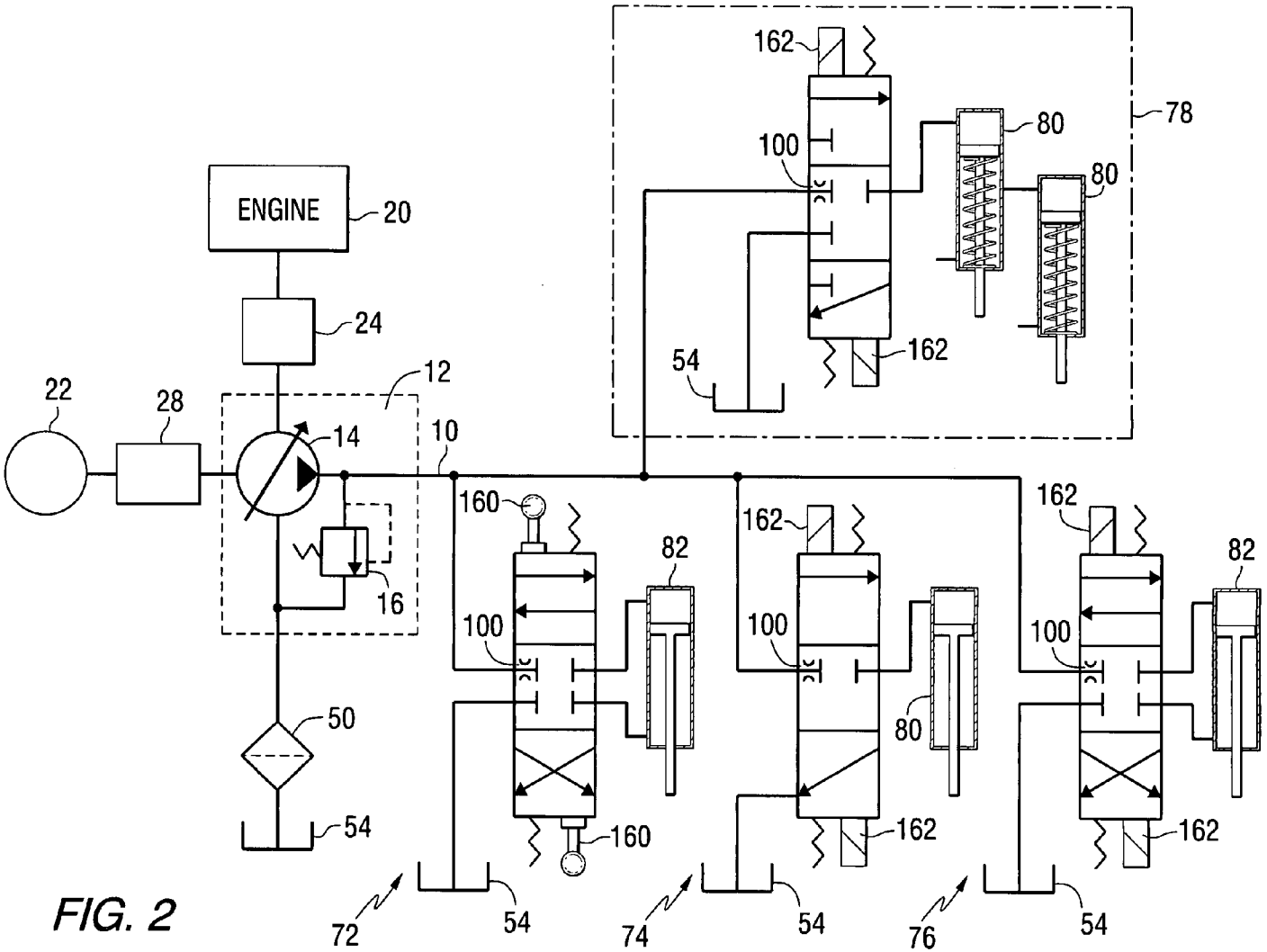
FIG. 2 is a schematic representation of the present invention with several hydraulic components illustrated.

FIG. 2 represents a hydraulic schematic showing an embodiment of the present invention. FIG. 2 is generally similar to FIG. 1, but with the addition of certain components associated with the connection of hydraulic devices to the fluid conduit 10. In relation to the various hydraulic devices, it should be understood that some can incorporate a manual mechanical control system 160 and others can incorporate an electrohydraulic control system 162. The hydraulic components schematically represented in FIG. 2 are a power steering system 72, a trim tab control system 74, a power trim and tilt control system 76, and a hydraulic transmission clutch system 78. The power trim 76, trim tab 74, and transmission clutch 78 circuits are illustrated as being controlled by electrohydraulic devices 162. The power steering circuit 72 is illustrated as being controlled by a manual mechanical control system 160, but it should be understood that it could alternatively be controlled by an electrohydraulic component such as that identified by reference numeral 162 in FIG. 2. It should also be recognized that, although each of the hydraulic devices is illustrated as having a reservoir 54 associated with it, a typical application of the present invention would utilize a common reservoir 54 associated with the hydraulic pump 14. As such, the fluid conduit 10 would comprise first and second conduits, wherein the first conduit conducts pressurized liquid from the hydraulic pump 14 to the various hydraulic devices and a second conduit would conduct the liquid from the various hydraulic devices along a return path to the liquid reservoir 54 associated with the hydraulic pump 14. Typically, the returning fluid is at a pressure of approximately 10–15 pounds per square inch. Also illustrated in FIG. 2 are single acting hydraulic cylinders 80 and double acting hydraulic cylinders 82. The clutch system 78 is provided with two single acting cylinders 80 connected as shown.

Figure 3:
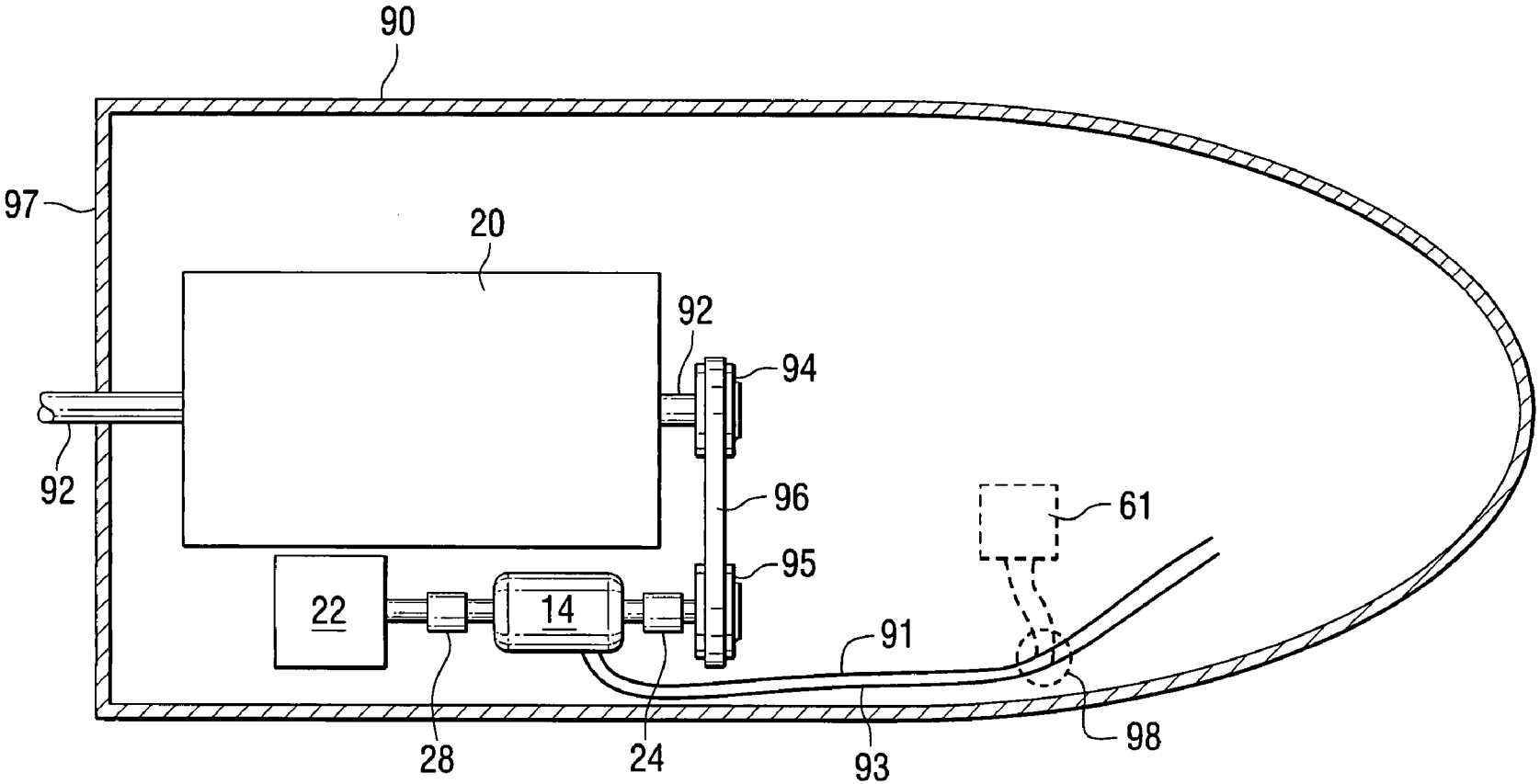
FIG. 3 is an illustration of a marine vessel which incorporates the present invention.

FIG. 3 is a schematic representation of a marine vessel 90 that is equipped with a hydraulic system of the present invention. Within the marine vessel 90, the engine 20 is supported to drive a marine propulsion system (not shown in FIG. 3) which is attached to its crankshaft 92 that extends through an opening in the transom 97. The crankshaft is also attached to a first pulley 94. A second pulley 95 is connected to the first pulley 94 by a belt 96. The engine 20, along with the pulley apparatus that comprises the first and second pulleys, 94 and 95, and the belt 96, is the first motive device of the present invention. The second motive device is the electric motor 22. The hydraulic pump 14 is provided with first and second clutches, 24 and 28, which allow it to be selectively driven by either the first or second motive devices, 20 or 22. When one of the clutches is activated, the other is deactivated and vice versa. It should be understood that the clutches can be overrun clutches or other similar devices that perform a similar function. In this way, the hydraulic pump 14 can be selectively connected, in torque transmitting relation, to either the first or second motive devices, 20 or 22, and the other motive device does not serve as a drag or resistance on the system. In other words, neither of the first or second motive devices, 20 or 22, is required to drive the other motive device when it is used to drive the hydraulic pump 14. This is accomplished through the use of the first and second clutches, 24 and 28.

In FIG. 3, the hydraulic pump 14 is shown provided with first and second conduits, 91 and 93, which are illustrated as being connected to a hydraulic device 61, by the connection illustrated in the dashed circle and identified by reference numeral 98. Although only a single hydraulic device 61 is illustrated in FIG. 3, it should be understood that the intent of the present invention is to provide a system to which a plurality of hydraulic devices can be connected.

With continued reference to FIGS. 1–3, it can be seen that the present invention combines all of the flow and pressure requirements of a marine vessel hydraulic system in a single hydraulic system. Instead of requiring three or four individual hydraulic systems, with each system having its own dedicated pump and motive device, the present invention supplies the necessary flow requirements for all of the hydraulic components on a marine vessel through the use of a single hydraulic pump 14 and two alternatively activated motive devices. The present invention therefore significantly reduces the number of components necessary to provide the hydraulic needs of a marine vessel. It simplifies the control of heat generation, of the hydraulic system, by controlling the flow of hydraulic fluid as a function of the actual demand for pressurized fluid by the hydraulic components, 61–65. In a typical application, the pressure in the fluid conduit is approximately 2500 psi. This pressure is directed to each of the hydraulic devices connected to the fluid conduit and each of these devices is typically provided with an orifice 100 to control the flow of fluid to that specific device. The present invention incorporates a pressure compensated hydraulic pump 14. The pump senses the system pressure in the fluid conduit 10 and compensates the flow to maintain that pressure within a preselected range. When no demand is placed on the system by the use of one or more of the hydraulic components, 61–65, the pump 14 would produce nearly zero flow. Some hydraulic systems typically result in a flow of approximately three gallons per minute at all times, regardless of the actual requirement for pressurized hydraulic fluid. However, other sizes of pumps and resulting flow rates are also well known to those skilled in the art. In addition, known systems typically incorporate an internal metering orifice and, as a result, the known types of hydraulic pumps typically produce more flow than the three gallons per minute described above. This results in wasted energy and excessive heat generation. When the hydraulic flow is reduced, the resulting heat generation of the pump is also reduced. This could eliminate the necessity for a heat exchanger.

As described above, the present invention uses a pressure compensated hydraulic pump. These types of pumps supply flow on demand while maintaining a preselected system pressure. These pressure compensated systems result in less energy loss due to the fact that only required flow is provided. The system, as illustrated in the figures, is also simplified by providing a single hydraulic system to which any and all of the hydraulic components can be connected. The prime mover of the hydraulic supply system comprises first and second motive devices, 20 and 22. The first motive device is an internal combustion engine and the second motive device is an electric motor. The provision of the second motive device 22 results from the necessity to be able to operate a power trim system 76 with the engine not running. In a marine vessel, it is necessary to allow the operator of the marine vessel to operate the power trim system without the engine running, as when the marine vessel is being moved onto a trailer for transportation. This is done by using the second motive device 22 with the second clutch 28 engaged and the first clutch 24 disengaged. When the engine 20 is started, the second clutch 28 is disengaged and the first clutch 24 is engaged. As a result, the hydraulic pump 14 is driven solely by the first motive device 20, or the internal combustion engine.

With continued reference to FIGS. 1–3, the pressure compensated pump 14 is designed with an integrated pressure relief valve system 16 in the event that a failure exists in the compensator system. The dashed lines identified by reference numeral 12 represent an assembly in which the relief valve is integrated with the pump body. The supply system also includes a filter assembly 50 and a reservoir 54. The hydraulic pump 14 supplies all of the required amount of hydraulic fluid to maintain the preselected system pressure in the fluid conduit 10. The pump outlet connects to the required direction control valves for the specific hydraulic components. Using the present invention, the flow distribution circuit connects in parallel, not in series, which is significantly different than known hydraulic systems for marine vessels. This allows the design of the hydraulic system to have various functions occurring at the same time without affecting the performance of other hydraulic devices. The hydraulic pump 14 senses the changes in supply pressure within the fluid conduit 10 and adjusts the flow automatically.

In known hydraulic systems, with each hydraulic device being provided with a separate hydraulic system, the systems have different pressure and flow requirements. With respect to the pressure requirements, all of the hydraulic components can be designed to operate at the same working pressure. With respect to flow, individual flow control devices, such as the orifices 100, can control the power steering, trim tabs, power trim and clutch requirements. The orifices 100 can be sized appropriately for each of the functional flow requirements for specific hydraulic devices. Although not described in detail above, it should be understood that the hydraulic system of the present invention can easily incorporate other hydraulic devices, such as hatch lifts and other hydraulic components.

Although the present invention has been described in particular detail and illustrated to show a preferred embodiment, it should be understood that alternative embodiments are also within its scope.

I claim:

1. A hydraulic system of a marine vessel, comprising:

a fluid conduit;

a hydraulic pump, said hydraulic pump being connected to said fluid conduit;

a first motive device which is selectably connectable in force transmitting relation with said hydraulic pump, said first motive device being an internal combustion engine and comprising a belt and pulley arrangement connecting said hydraulic pump in torque transmitting relation with said internal combustion engine, said engine having an aft-extending crankshaft extending in a first direction through an opening in a transom of said marine vessel, said engine having a forward-extending crankshaft extending in a second direction opposite to said first direction, said belt and pulley arrangement being connected to said forward-extending crankshaft; and a second motive device which is selectably connectable in force transmitting relation with said hydraulic pump.

2. The hydraulic system of claim 1, further comprising:

a first clutch connected between said hydraulic pump and said first motive device to alternatively connect said first motive device to said hydraulic pump and disconnect said first motive device from said hydraulic pump.

3. The hydraulic system of claim 1, further comprising:

a second clutch connected between said hydraulic pump and said second motive device to alternatively connect said second motive device to said hydraulic pump and disconnect said second motive device from said hydraulic pump.

4. The hydraulic system of claim 1, wherein:

said hydraulic pump is configured to maintain a preselected pressure within said fluid conduit.

5. The hydraulic system of claim 1, wherein:

said hydraulic pump is a pressure compensated pump.

6. The hydraulic system of claim 1, wherein:

said second motive device comprises an electric motor which is connected in torque transmitting relation with said hydraulic pump.

7. The hydraulic system of claim 1, further comprising:

a battery, said battery being connectable to said second motive device to provide electrical power to said second motive device when said second motive device is connected in force transmitting relation with said hydraulic pump.

8. The hydraulic system of claim 1, further comprising:

a hydraulically driven device connected in fluid communication with said fluid conduit.

9. The hydraulic system of claim 8, wherein:

said hydraulically driven device is selected from the group consisting of a power steering system, a trim tab, a power trim system, and a hydraulic transmission clutch.

10. The hydraulic system of claim 1, wherein:

said fluid conduit comprises a first conduit for conducting a pressurized liquid from said hydraulic pump and a second conduit for conducting said pressurized liquid to a liquid reservoir.

11. A hydraulic system of a marine vessel, comprising:

a fluid conduit;

a hydraulic pump, said hydraulic pump being connected to said fluid conduit;

a first motive device which is selectably connectable in force transmitting relation with said hydraulic pump;

a second motive device which is selectably connectable in force transmitting relation with said hydraulic pump;

a plurality of hydraulically driven devices connected in parallel to said fluid conduit; and a plurality of orifices each dedicated for individual flow control of a respective hydraulically driven device, said hydraulically driven devices having different pressure and flow requirements, said hydraulically driven devices are selected from the group consisting of a power steering system, a trim tab, a power trim system, and a hydraulic transmission clutch.

12. The hydraulic system of claim 11, wherein said fluid conduit comprises a first fluid conduit comprising a supply conduit supplying pressurized hydraulic fluid to said hydraulically driven devices, and comprising a second fluid conduit comprising a common return conduit returning hydraulic fluid to a single common reservoir.

13. The hydraulic system of claim 12, wherein said single common reservoir is at said hydraulic pump.

* * * * *